US005161331A

United States Patent [19]

Zambon

[11] Patent Number: 5,161,331

[45] Date of Patent: Nov. 10, 1992

[54] ROTATING HEAD HAVING OSCILLATING BLOCKS FOR LEVELING AND POLISHING SURFACES OF GRANITE, CERAMIC OR MARBLE

[75] Inventor: Angelo Zambon, Piovene Rocchette, Italy

[73] Assignee: Officine Meccaniche F.LLi Zambon s.n.c, Schio, Italy

[21] Appl. No.: 672,354

[22] Filed: Mar. 20, 1991

[30] Foreign Application Priority Data

Mar. 27, 1990 [IT] Italy ..... 85551 A/90

[51] Int. Cl.[5] ..... B24B 7/22

[52] U.S. Cl. ..... 51/55; 51/283 R; 51/174

[58] Field of Search ..... 51/32, 54, 90, 43, 55, 51/57, 58, 209 R, 174, 170 T, 177, 283 R, 31, 33 R, 35, 47, 72; 125/25

[56] References Cited

U.S. PATENT DOCUMENTS

| | | | |
|---|---|---|---|
| 2,582,470 | 1/1952 | Walker | 51/358 |
| 4,965,965 | 10/1990 | Wallin | 51/55 |

FOREIGN PATENT DOCUMENTS

| | | | |
|---|---|---|---|
| 3408443 | 9/1984 | Fed. Rep. of Germany | 51/33 R |
| 1153833 | 3/1958 | France | 51/90 |
| 0491610 | 9/1938 | United Kingdom | 51/209 |

*Primary Examiner*—Robert A. Rose

*Attorney, Agent, or Firm*—Bucknam and Archer

[57] ABSTRACT

The rotating head comprises oscillating blocks 1 mounted on inclined pins 2 connected by means of connecting rods 5, the rods being mounted on eccentric pins fixed to toothed helicoidal wheels 9. The wheels mesh with a worm screw 10 having a vertical axis, the worm screw being mounted on the fixed structure of the apparatus. The entire complex is mobile at reduced speed, a fact which reduces the wear and consequently the necessity of maintenance and substitution of parts during operation.

2 Claims, 2 Drawing Sheets

ROTATING HEAD HAVING OSCILLATING BLOCKS FOR LEVELING AND POLISHING SURFACES OF GRANITE, CERAMIC OR MARBLE

The present invention relates to rotating heads having oscillating blocks, for leveling and polishing surfaces of granite, ceramic or marble.

The novel feature of the present invention resides essentially in the fact that the mechanisms which control the motion of oscillation of the operating heads are put in operation by means of a worm screw which is mounted in a fixed position on the central axis of the rotating head.

It is known according to the present state of the art that the rotating heads having oscillating blocks used for leveling and polishing surfaces of granite, ceramic or marble are provided with mechanisms having toothed wheels which are coupled to shaped cams which permit to obtain the motions of oscillation of the blocks. This type of mechanism involves substantial drawbacks which are well known to the people using this type of machine, drawbacks due to the substantial and unavoidable friction present in the control mechanisms. In particular, it is always required to use a satellite mechanism which must rotate at high speed and must have reduced dimensions for the purpose of being contained within the space available in the interior of the box of the device. Consequently, substantial problems of wear occur and also it is necessary to use great care in the operation of these machines.

With the mechanism with a worm screw according to the present invention, together with the helicoidal wheels, the drawbacks mentioned hereinabove are substantially reduced because the mechanisms rotating at high speed and the shaped control cam are eliminated so that the wear of the mechanical parts which constitute the mechanism is reduced and the overall cost is also reduced.

Another novel feature of the present invention is that each oscillating block is provided with a control connecting rod which acts directly on the block by means only if the interposition of ball joints. In this manner, the control mechanism of the motion of oscillation of the same blocks is simplified.

The invention will be described in more detail hereinbelow, by reference to the accompanying drawings of which:

Figure 1:
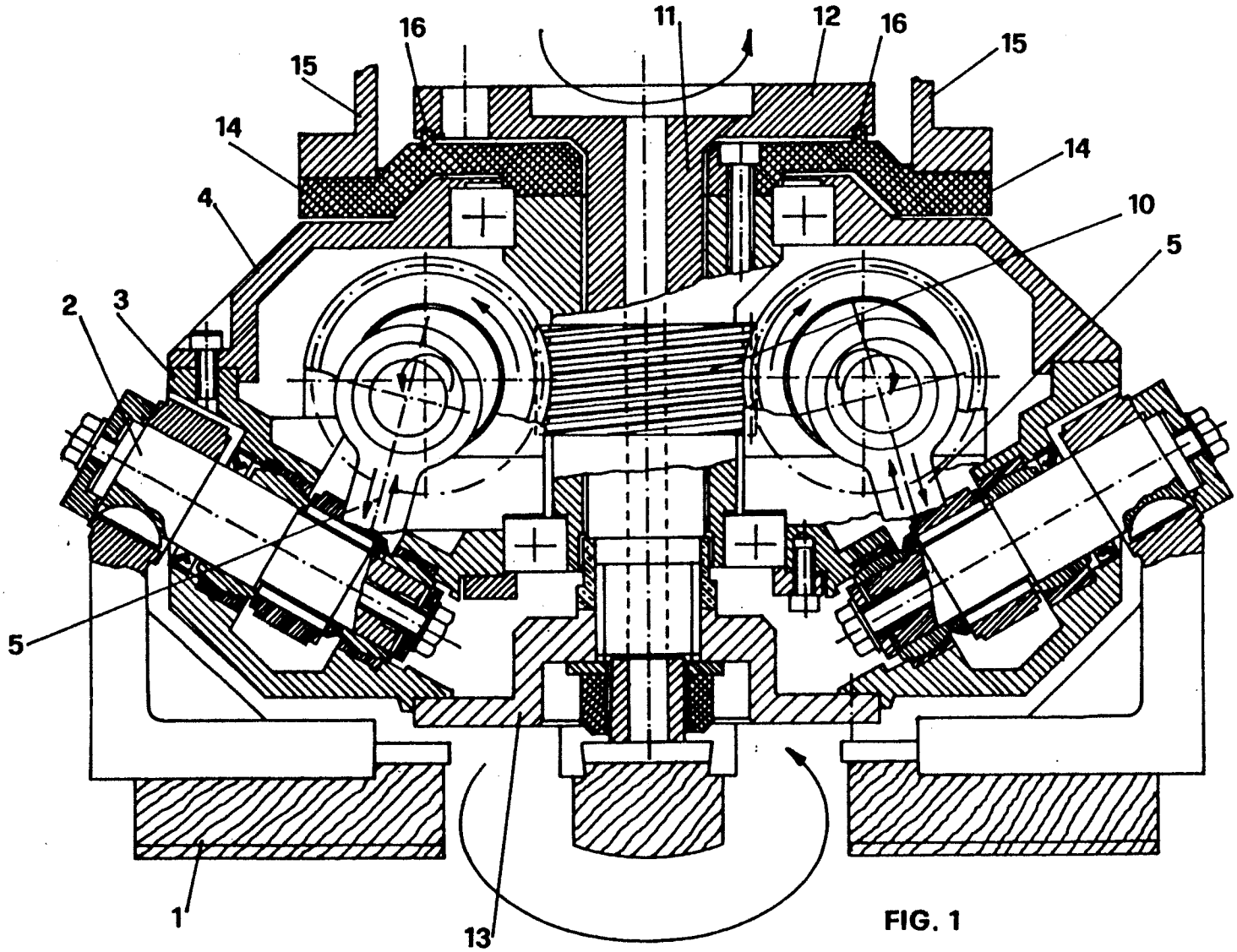
FIG. 1, is an axial cross section of the rotating head of the present invention.
Figure 2:
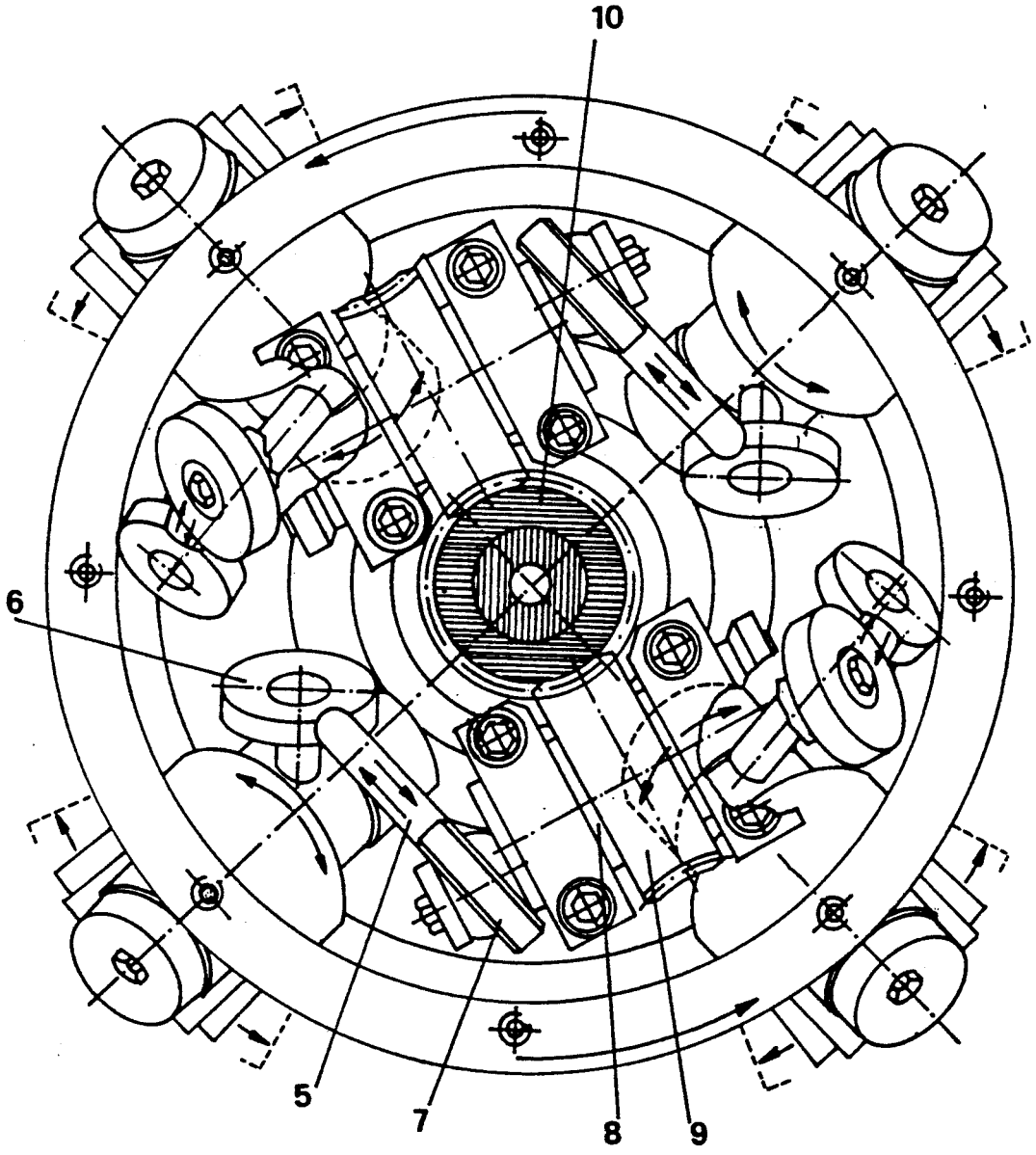
FIG. 2 is a top view of the same rotating head without the closing cover.

As shown particularly in FIG. 1, the operating head comprises oscillating blocks 1 which rotate on inclined pins 2, the latter being mounted on the case of the head 3 which is closed at the top by cover 4. The motion of oscillation of the blocks 1 is actuated by the connecting rods 5 which connect the ball joints 6 which are shown in FIG. 2, the latter being connected to each pin 2, with a second ball joint 7 which is connected to pin 8. Numeral 9 designates the toothed wheels having helicoidal teeth which are mounted on the pin 8. The toothed wheels 9 mesh with the worm screw 10 which is fixedly mounted on the central axis of the head.

The rotation of the head 11 is caused by the central axis 1. The latter is connected by means of a flange 12 to the control motor (not shown). In this manner, the rotation of the head permits to place in rotation the flange 13 which in turn places in rotation the case 4, the latter carrying the blocks 1 through the pins 2. The worm screw 10 on the contrary is fixed to the carrying plate 14 which is fixed by means of a coupling 15 to the head of the machine.

The circular projection 16 which penetrates within a corresponding circular groove formed in the external face of flange 12, prevents dust, which is always present in great amounts in the operating space, to penetrate within the bearings of the apparatus. For the same reason, the entire complex comprising the worm screw 10, the two toothed helicoidal wheels 9 and the connecting rods 5 which place in oscillation the blocks 1 through the pins 2, is enclosed in an oil bath in a closed case so that dust does not enter the case while it circulates in great amount in the operating space.

The advantages of the rotating head according to the present invention are obvious if one considers that by providing the motion of oscillation to the blocks 1 by means of a worm screw 10 and helicoidal wheels 9, which are connected by means of linkages to the shafts which carry the blocks 1, there are no mechanical transmissions rotating with a high number of turns which unavoidably would cause great wear and consequently would require frequent intervention for the maintenance of the apparatus and substitution of parts.

Naturally, the details described hereinabove and illustrated in the drawings merely refer to a particular embodiment of the invention which has been described by way of example but is not intended to limit the invention because the invention may take different aspects while retaining the essential characteristics of this invention. For instance, it is possible that the head may be made with 6 or 8 oscillating sectors utilizing in this case three or four toothed crowns disposed among themselves at an angular distance of 120 degrees or 90 degrees while being controlled by a single worm screw.

What is claimed is:

1. A rotating head for leveling and polishing a surface of granite, ceramic or marble comprising a case (4) a predetermined number of abrasive blocks (1), each of said blocks (1) oscillating on a respective pin (2), said pins (2) being mounted on said case (4), said case being placed in rotation through a vertical shaft (11), said vertical shaft being connected by means of a flange (12) to a control motor, characterized by the fact that the motion of oscillation of the blocks (1) is obtained by means of wheels (9) having helicoidal teeth engaging with a worm screw (10), said worm screw having a vertical axis fixed to the case (15) said helicoidally toothed wheels being connected by means of eccentrically mounted connecting rods (5) to the blocks (1) whereby said blocks (1) are placed in oscillation with a compact mechanism.

2. A rotating head according to claim 1 characterized by the fact that each connecting rod (5) is connected by means of a first ball joint (6), said first ball joint being mounted on an arm which emerges radially from pin (2), said pin (2) carrying the oscillating block (1), and at the opposite end said connecting rod (5) is connected by means of a second ball joint (7) to an eccentric pin which rotates with the helicoidally toothed wheel (9), each of said wheels meshing with said worm screw (10) which is fixed to the central vertical axis.

* * * * *